US008607870B2

(12) United States Patent
Gu et al.

(10) Patent No.: US 8,607,870 B2
(45) Date of Patent: Dec. 17, 2013

(54) METHODS TO CREATE HIGH CONDUCTIVITY FRACTURES THAT CONNECT HYDRAULIC FRACTURE NETWORKS IN A WELL

(75) Inventors: Hongren Gu, Sugar Land, TX (US); Yiyan Chen, Sugar Land, TX (US); Xiaowei Weng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 245 days.

(21) Appl. No.: 12/950,226

(22) Filed: Nov. 19, 2010

(65) Prior Publication Data

US 2012/0125617 A1 May 24, 2012

(51) Int. Cl.
*E21B 43/26* (2006.01)
*E21B 43/267* (2006.01)

(52) U.S. Cl.
USPC ..... 166/308.1; 166/280.1; 166/308.2; 166/308.3

(58) Field of Classification Search
USPC ..... 166/280.1, 280.2, 305.1, 307, 308.1
See application file for complete search history.

(56) References Cited

U.S. PATENT DOCUMENTS

| | | | |
|---|---|---|---|
| 2,193,775 | A | 3/1940 | Stratford |
| 2,513,944 | A | 7/1950 | Kessler |
| RE24,570 | E | 11/1958 | Mangold et al. |
| 2,905,245 | A | 9/1959 | De Priester |
| 3,362,475 | A | 1/1968 | Huitt |
| 3,434,540 | A | 3/1969 | Stein |
| 3,675,717 | A | 7/1972 | Goins et al. |
| 3,887,474 | A | 6/1975 | Senfe et al. |
| 3,937,283 | A | 2/1976 | Blauer et al. |
| 4,051,900 | A | 10/1977 | Hankins |

(Continued)

FOREIGN PATENT DOCUMENTS

| | | |
|---|---|---|
| EP | 1236701 | 9/2002 |
| EP | 1534926 | 11/2009 |

(Continued)

OTHER PUBLICATIONS

SPE 131783—Less Sand May Not Be Enough, M. Curry, T. Maloney, R. Woodroff, and R. Leonard, Feb. 23-25, 2010, SPE Unconventional Gas Conference, Pittsburgh, PA, USA.

(Continued)

*Primary Examiner* — Angela M DiTrani
*Assistant Examiner* — Anuradha Ahuja
(74) *Attorney, Agent, or Firm* — Matthieu Vandermolen; Daryl Wright; Tim Curington

(57) ABSTRACT

The invention discloses a method of treating a subterranean formation of a well bore, that provides a first treatment fluid; subsequently, pumps the first treatment fluid to initiate a network of low conductivity fractures in the subterranean formation; provides a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; and subsequently, pumps the second treatment fluid to initiate at least one high conductivity fracture in the subterranean formation, wherein the high conductivity fracture has a conductivity higher than the average of the conductivity of the low conductivity fractures and connects the network of the low conductivity fractures.

29 Claims, 5 Drawing Sheets

(56) References Cited

U.S. PATENT DOCUMENTS 4,387,769 A 6/1983 Erbstoesser et al.
4,506,734 A 3/1985 Nolte
4,526,695 A 7/1985 Erbstoesser et al.
4,606,407 A 8/1986 Shu
4,665,988 A 5/1987 Murphey et al.
4,670,166 A 6/1987 McDougall et al.
4,718,490 A 1/1988 Uhri
4,738,897 A 4/1988 McDougall et al.
4,785,884 A 11/1988 Armbruster
4,848,467 A 7/1989 Cantu et al.
4,867,241 A 9/1989 Strubhar
4,883,124 A 11/1989 Jennings, Jr.
4,917,185 A 4/1990 Jennings, Jr. et al.
4,951,751 A 8/1990 Jennings, Jr.
4,968,353 A 11/1990 Kawasaki et al.
4,968,354 A 11/1990 Nishiura et al.
4,977,961 A 12/1990 Avasthi
4,986,355 A 1/1991 Casad et al.
5,036,920 A 8/1991 Cornette et al.
5,095,987 A 3/1992 Weaver et al.
5,161,618 A 11/1992 Jones et al.
5,188,837 A 2/1993 Domb
5,238,067 A 8/1993 Jennings et al.
5,325,921 A * 7/1994 Johnson et al. ..... 166/280.1
5,330,005 A 7/1994 Card et al.
5,332,037 A 7/1994 Schmidt et al.
5,333,689 A 8/1994 Jones et al.
5,415,228 A 5/1995 Price et al.
5,439,055 A 8/1995 Card et al.
5,492,178 A 2/1996 Nguyen et al.
5,501,274 A 3/1996 Nguyen et al.
5,501,275 A 3/1996 Card et al.
5,507,342 A 4/1996 Copeland et al.
5,518,996 A 5/1996 Maroy et al.
5,551,516 A 9/1996 Norman et al.
5,629,271 A 5/1997 Dobson, Jr. et al.
5,713,416 A 2/1998 Chatterji et al.
5,741,758 A 4/1998 Pakulski
5,893,416 A 4/1999 Read
5,908,073 A 6/1999 Nguyen et al.
5,922,652 A 7/1999 Kowalski et al.
5,934,376 A 8/1999 Nguyen et al.
5,964,291 A 10/1999 Bourne et al.
5,979,557 A 11/1999 Card et al.
6,059,034 A 5/2000 Rickards et al.
6,114,410 A 9/2000 Betzold
6,172,011 B1 1/2001 Card et al.
6,209,643 B1 4/2001 Nguyen et al.
6,209,646 B1 4/2001 Reddy et al.
6,239,183 B1 5/2001 Farmer et al.
6,258,859 B1 7/2001 Dahayanake et al.
6,279,656 B1 8/2001 Sinclair et al.
6,302,207 B1 10/2001 Nguyen et al.
6,326,335 B1 12/2001 Kowalski et al.
6,328,105 B1 12/2001 Betzold
6,330,916 B1 12/2001 Rickards et al.
6,379,865 B1 4/2002 Mao et al.
6,380,136 B1 4/2002 Bates et al.
6,435,277 B1 8/2002 Qu et al.
6,439,309 B1 8/2002 Matherly et al.
6,446,722 B2 9/2002 Nguyen et al.
6,482,517 B1 11/2002 Anderson
6,506,710 B1 1/2003 Hoey et al.
6,543,538 B2 4/2003 Tolman et al.
6,559,245 B2 5/2003 Mao et al.
6,599,863 B1 7/2003 Palmer et al.
6,656,265 B1 12/2003 Garnier et al.
6,703,352 B2 3/2004 Dahayanake et al.
6,719,054 B2 4/2004 Cheng et al.
6,723,683 B2 4/2004 Crossman et al.
6,725,930 B2 4/2004 Boney et al.
6,742,590 B1 6/2004 Nguyen
6,776,235 B1 8/2004 England
6,818,594 B1 11/2004 Freeman et al.
6,828,280 B2 * 12/2004 England et al. ..... 507/202
6,860,328 B2 3/2005 Gonzalez et al.
6,874,578 B1 4/2005 Garnier et al.
6,877,560 B2 4/2005 Nguyen et al.
6,938,693 B2 9/2005 Boney et al.
6,989,195 B2 1/2006 Anderson
7,004,255 B2 2/2006 Boney
7,028,775 B2 4/2006 Fu et al.
7,044,220 B2 5/2006 Nguyen et al.
7,044,224 B2 5/2006 Nguyen
7,049,272 B2 5/2006 Sinclair et al.
7,060,661 B2 6/2006 Dobson, Sr. et al.
7,066,260 B2 6/2006 Sullivan et al.
7,084,095 B2 8/2006 Lee et al.
7,148,185 B2 12/2006 Fu et al.
7,166,560 B2 1/2007 Still et al.
7,178,596 B2 2/2007 Blauch et al.
7,210,528 B1 * 5/2007 Brannon et al. ..... 507/140
7,213,651 B2 * 5/2007 Brannon et al. ..... 166/308.2
7,219,731 B2 5/2007 Sullivan
7,237,610 B1 7/2007 Saini et al.
7,261,157 B2 8/2007 Nguyen et al.
7,265,079 B2 9/2007 Willberg et al.
7,267,170 B2 9/2007 Mang et al.
7,275,596 B2 10/2007 Willberg et al.
7,284,611 B2 10/2007 Reddy et al.
7,290,615 B2 11/2007 Christanti et al.
7,294,347 B2 11/2007 Menjoge et al.
7,303,018 B2 12/2007 Cawiezel et al.
7,398,826 B2 7/2008 Hoefer et al.
7,405,183 B2 7/2008 Hanes, Jr.
7,419,937 B2 9/2008 Rimmer et al.
7,451,812 B2 11/2008 Cooper et al.
7,482,311 B2 1/2009 Willberg et al.
7,493,955 B2 2/2009 Gupta et al.
7,510,009 B2 3/2009 Cawiezel et al.
7,528,096 B2 5/2009 Brannon et al.
7,559,369 B2 7/2009 Roddy et al.
7,565,929 B2 * 7/2009 Bustos et al. ..... 166/279
7,581,590 B2 9/2009 Lesko et al.
7,624,802 B2 12/2009 McCrary et al.
7,644,761 B1 1/2010 Gu et al.
7,784,541 B2 * 8/2010 Hartman et al. ..... 166/280.1
7,789,146 B2 9/2010 Panga et al.
7,806,182 B2 * 10/2010 Waters et al. ..... 166/280.2
7,833,947 B1 * 11/2010 Kubala ..... 507/200
7,923,415 B2 4/2011 Panga et al.
7,931,088 B2 4/2011 Stegemoeller et al.
7,954,548 B2 6/2011 Curimbaba et al.
7,973,991 B2 7/2011 Watanabe
8,008,234 B2 8/2011 Panga et al.
8,119,574 B2 2/2012 Panga et al.
8,167,043 B2 5/2012 Willberg et al.
8,210,249 B2 7/2012 Panga et al.
2003/0054962 A1 * 3/2003 England et al. ..... 507/117
2003/0134751 A1 7/2003 Lee et al.
2004/0060702 A1 4/2004 Kotlar et al.
2004/0074646 A1 4/2004 Kotlar et al.
2004/0106525 A1 6/2004 Willberg et al.
2004/0152601 A1 8/2004 Still et al.
2004/0209780 A1 10/2004 Harris et al.
2004/0261993 A1 12/2004 Nguyen
2004/0261995 A1 12/2004 Nguyen et al.
2004/0261996 A1 12/2004 Munoz, Jr. et al.
2005/0027499 A1 2/2005 Bourbiaux et al.
2005/0103496 A1 5/2005 Todd et al.
2005/0130845 A1 6/2005 Freeman et al.
2005/0130848 A1 6/2005 Todd et al.
2005/0161220 A1 7/2005 Todd et al.
2005/0172699 A1 8/2005 Hu et al.
2005/0233895 A1 10/2005 Mertens et al.
2005/0252659 A1 11/2005 Sullivan et al.
2005/0274523 A1 12/2005 Brannon et al.
2006/0006539 A1 1/2006 Matsui et al.
2006/0048943 A1 3/2006 Parker et al.
2006/0048944 A1 3/2006 van Batenburg et al.
2006/0052251 A1 3/2006 Anderson et al.
2006/0054324 A1 3/2006 Sullivan et al.
2006/0058197 A1 3/2006 Brown et al.
2006/0073980 A1 4/2006 Brannon et al.

(56) References Cited

U.S. PATENT DOCUMENTS

| | | | | |
|---|---|---|---|---|
| 2006/0113078 | A1 | 6/2006 | Nguyen et al. | |
| 2006/0124302 | A1 | 6/2006 | Gupta et al. | |
| 2006/0151173 | A1 | 7/2006 | Slabaugh et al. | |
| 2006/0157243 | A1* | 7/2006 | Nguyen | 166/280.2 |
| 2006/0175059 | A1 | 8/2006 | Sinclair et al. | |
| 2006/0185848 | A1 | 8/2006 | Surjaatmadja et al. | |
| 2006/0289160 | A1 | 12/2006 | van Batenburg et al. | |
| 2007/0017675 | A1 | 1/2007 | Hammami et al. | |
| 2007/0029086 | A1 | 2/2007 | East, Jr. | |
| 2007/0039733 | A1 | 2/2007 | Welton et al. | |
| 2007/0042912 | A1 | 2/2007 | Welton et al. | |
| 2007/0044963 | A1 | 3/2007 | MacDougall | |
| 2007/0238623 | A1 | 10/2007 | Saini et al. | |
| 2008/0000391 | A1 | 1/2008 | Drochon | |
| 2008/0000638 | A1 | 1/2008 | Burukhin et al. | |
| 2008/0053657 | A1 | 3/2008 | Alary et al. | |
| 2008/0066910 | A1 | 3/2008 | Alary et al. | |
| 2008/0093073 | A1* | 4/2008 | Bustos et al. | 166/279 |
| 2008/0103065 | A1 | 5/2008 | Reddy et al. | |
| 2008/0108520 | A1 | 5/2008 | Fu | |
| 2008/0121395 | A1 | 5/2008 | Reddy et al. | |
| 2008/0135250 | A1 | 6/2008 | Bosma et al. | |
| 2008/0210423 | A1 | 9/2008 | Boney | |
| 2008/0280788 | A1 | 11/2008 | Parris et al. | |
| 2008/0280790 | A1 | 11/2008 | Mirakyan et al. | |
| 2008/0314594 | A1 | 12/2008 | Still et al. | |
| 2008/0318026 | A1 | 12/2008 | Dai et al. | |
| 2009/0008095 | A1 | 1/2009 | Duncum et al. | |
| 2009/0025394 | A1 | 1/2009 | Bonzani et al. | |
| 2009/0025932 | A1* | 1/2009 | Panga et al. | 166/278 |
| 2009/0025934 | A1* | 1/2009 | Hartman et al. | 166/280.2 |
| 2009/0107671 | A1* | 4/2009 | Waters et al. | 166/280.1 |
| 2009/0294126 | A1 | 12/2009 | Dalrymple et al. | |
| 2010/0000735 | A1 | 1/2010 | Weaver et al. | |
| 2010/0087341 | A1 | 4/2010 | Alary et al. | |
| 2010/0087342 | A1 | 4/2010 | Alary et al. | |
| 2010/0089580 | A1* | 4/2010 | Brannon et al. | 166/280.2 |
| 2010/0126722 | A1 | 5/2010 | Cornelissen et al. | |
| 2010/0200247 | A1 | 8/2010 | Dybevik et al. | |
| 2010/0300688 | A1 | 12/2010 | Panga et al. | |
| 2011/0005760 | A1 | 1/2011 | Hartman et al. | |
| 2011/0053813 | A1 | 3/2011 | Panga et al. | |
| 2011/0098202 | A1 | 4/2011 | James et al. | |
| 2011/0155371 | A1 | 6/2011 | Panga et al. | |
| 2011/0198089 | A1 | 8/2011 | Panga et al. | |
| 2012/0000641 | A1 | 1/2012 | Panga et al. | |
| 2012/0000651 | A1 | 1/2012 | Panga et al. | |
| 2012/0132421 | A1 | 5/2012 | Loiseau et al. | |
| 2012/0138296 | A1 | 6/2012 | Panga et al. | |
| 2012/0247764 | A1 | 10/2012 | Chen et al. | |
| 2012/0305254 | A1 | 12/2012 | Chen et al. | |

FOREIGN PATENT DOCUMENTS

| | | |
|---|---|---|
| GB | 2277543 | 2/1994 |
| RU | 2065442 | 8/1996 |
| RU | 2221130 | 1/2004 |
| RU | 2376451 | 12/2009 |
| RU | 2404359 | 11/2010 |
| RU | 2413064 | 2/2011 |
| RU | 2417243 | 4/2011 |
| WO | 9930249 | 6/1999 |
| WO | 2004007904 | 1/2004 |
| WO | 2004038176 | 5/2004 |
| WO | 2006082359 | 8/2006 |
| WO | 2009013710 | 1/2009 |
| WO | 2009088317 | 7/2009 |
| WO | 2009106796 | 9/2009 |
| WO | 2009141749 | 11/2009 |
| WO | 2010117547 | 10/2010 |
| WO | 2011024100 | 3/2011 |
| WO | 2011129937 | 10/2011 |
| WO | 2011143055 | 11/2011 |
| WO | 2012001574 | 1/2012 |

OTHER PUBLICATIONS

ARMA/USRMS 05-780—Experiments and numerical simulation of hydraulic fracturing in naturally fractured rock, C.J. De Pater and L.J.L. Beugelsdijk, Jun. 25-29, 2005, The 40th U.S. Symposium of Rock Mechanics (USRMS), Anchorage, AK, USA.

Kirk-Othmer Encyclopedia of Chemical Technology, vol. 17, pp. 143-167 (1982), "Petroleum (Drilling Fluids)".

Kirk-Othmer Enclyclopedia of Chemical Technology, vol. 7, pp. 297-299 (1965).

Nolte, K.G.: "Application of Fracture Design Based on Pressure Analysis," SPE13393—SPE Production Engineering, vol. 3, No. 1, 31-42, Feb. 1988.

Nolte, K.G. and Smith, M.B.: "Interpretation of Fracturing Pressures,"—SPE8297—JPT, vol. 12, No. 8, pp. 1767-1775, Sep. 1981.

Smith, M.B., Miller II, W.K., and Haga, J.: "Tip Screenout Fracturing: A Technique for Soft, Unstable Formations," SPE13273—SPE Production Engineering, vol. 2, No. 2, 95-103, May 1987.

Asgian, M.I., Cundall, P.A., and Brady, B.H. (1995) "Mechanical Stability of Porpped Hydraulic Fractures: A Numerical Study",—SPE28510—JPT, 203-208, Mar. 1995.

Milton-Tayler, D., Stephenson, C., and Asgian, M. (1992) "Factors Affecting the Stability of Proppant in Propped Fractures: Results of a Laboratory Study," paper SPE 24821 presented at the SPE Annual Technical Conference and Exhibition, Washington, DC, Oct. 4-7, pp. 571-579.

Thiercelin, M., et al. (1993) On the Modeling of Near Tip Processes in Hydraulic Fractures. International journal of rock mechanics and mining sciences & geomechanics abstracts, 30(7): pp. 537-540.

Desroches, J., et al. (1994) The Crack Tip Region in Hydraulic Fracturing. Proc. R. Soc. Lond. A, 447: p. 39-48.

Schlumberger CemCRETE Brochure (2003).

Schlumberger Cementing Services and Products—Materials, pp. 39-76 (2012).

SPE 119366—Fracture Design Considerations in Horizontal Wells Drilled in Unconventional Gas Reservoirs; Cipolla, C.L., Lolon, E.P., Mayerhofer, M.J., and Warpinski, N.R. (2009), pp. 1-10.

International Preliminary Report on Patentability for International Patent Application No. PCT/US2011/061234 issued May 21, 2013 (10 pages).

* cited by examiner

METHODS TO CREATE HIGH CONDUCTIVITY FRACTURES THAT CONNECT HYDRAULIC FRACTURE NETWORKS IN A WELL

FIELD OF THE INVENTION

The invention relates to methods for treating subterranean formations. More particularly, the invention relates to methods for stimulation treatment to create high conductivity hydraulic fractures that connect low conductivity hydraulic fracture networks.

BACKGROUND

The statements in this section merely provide background information related to the present disclosure and may not constitute prior art.

Hydrocarbons (oil, condensate, and gas) are typically produced from wells that are drilled into the formations containing them. For a variety of reasons, such as inherently low permeability of the reservoirs or damage to the formation caused by drilling and completion of the well, the flow of hydrocarbons into the well is undesirably low. In this case, the well is "stimulated" for example using hydraulic fracturing, chemical (usually acid) stimulation, or a combination of the two (called acid fracturing or fracture acidizing).

Hydraulic Fracturing is a stimulation process commonly used in order to enhance hydrocarbon (oil and gas) productivity from the earth formations where these resources are accumulated. During hydraulic fracturing, a fluid is pumped at rates and pressures that cause the downhole rock to fracture. Typical stages of a fracturing treatment are the fracture initiation, fracture propagation and fracture closure. During fracture initiation fluids are pumped into a wellbore connected to the formation through entry points such as slots, or perforations, to create a typically biplanar fracture in the rock formation. During propagation, fluids are pumped to grow the fracture primarily in the longitudinal and vertical direction, for which fluids are pumped into the wellbore at rates exceeding the rate of fluid filtration into the formation, or fluid loss rate. Optimal fracturing fluids pumped to propagate fractures typically have rheological characteristics that promote a reduction of the fluid loss rate, and serve the purpose of maintaining a certain width of the created fracture at the rate and pressure at which the fluid is pumped downhole, what in return increases the efficiency of the treatment, defined as the volume of fracture created divided by the volume of fluid pumped. Upon cessation of flow, the downhole formation tends to close the fracture forcing the fluid in the fracture to further filtrate into the formation, and or into the wellbore.

In some treatments, know as acid fracturing treatments, in order to maintain some connectivity between the created fracture and the wellbore, acids are incorporated into the fluid (dissolved, or suspended) which are capable of etching some of the minerals in the formation faces, thus creating areas of misalignment through which hydrocarbons can flow into the wellbore from the formation.

In other treatments, known as propped fracturing treatments, solid particulates of sizes substantially bigger than the grains in the formation known as proppant, which are capable of substantially withstanding the closure stress, are pumped with the fluid in order to prevent complete fracture closure (prop the fracture open) and to create a conductive path for the hydrocarbons.

A few different methods of creating propped hydraulic fractures are known. Many treatments requiring a substantial width formation resort to the use of viscous fluids capable of reducing fluid loss, typically aqueous polymer or surfactant solutions, foams, gelled oils, and similar viscous liquids to initiate and propagate the fracture, and to transport the solids into the fracture. In these treatments the fluid flow rate is maintained at a relatively high pump rate, in order to continuously propagate the fracture and maintain the fracture width. A first fluid, known as pad, is pumped to initiate the fracture, which is pushed deeper into the reservoir by propagating the fracture, by the fluid pumped at later stages, known as slurry, which typically contains and transports the proppant particles. In general the viscosity of pad and slurry are similar, facilitating the homogeneous displacement of the pad fluid, without substantial fingering of one fluid into the other.

Recently a different method of creating propped fractures has been proposed in which a viscous fluid and a slurry fluid are alternated at a very high frequency, allowing for heterogeneous placement of proppant in the formation.

Another method of creating propped fractures very common in low permeability reservoirs where fluid viscosity is not typically required to reduce fluid loss is the use of high rate water fracs or slick water fracs. In these treatments, the low viscosity slurry is typically not able to substantially suspend the proppant, which sinks to the bottom of the fracture, and the treatment relies on the turbulent nature of the flow of a low viscosity fluid pumping at a very high velocity above the proppant to push the proppant deeper into the formation in a process called dunning, (because is similar to the dune formation in sandy areas, where the wind fluidizes the sand grains on the surface, and transports it for a short distance until they drop by gravity), creating a front that smoothly advances deeper and deeper into the fracture. In this case, proppant slugs are pumped, at very low proppant concentrations to prevent near wellbore deposition (screenout) followed by clean fluid slugs aiming to push the sand away from the wellbore.

Hybrid treatments where fractures are opened with one type of the fluids and propped with a different fluid can be envisioned and are also known, and practiced in the industry.

The common practice when shale gas formations are treated is to use slick water fluids at low concentration (0.25 to 3 ppa) of proppant to create large fracture surface area in the form of long and complex fracture networks. Since the fluid viscosity is low (e.g. 1-10 cp), the created fracture width is narrow. Low fluid viscosity also makes proppant transport difficult due to large settling velocity. Therefore, small diameter (40/70 to 100 mesh sizes) proppant at low concentration is generally used in fracturing treatments in shale gas formations. Low fluid viscosity and low proppant size and concentration contribute to low fracture conductivity and potential poor and sustainable fracture connectivity with the wellbore.

A recent post-stimulation production analysis shows that the increased production is less than expected, and production decline is more than expected (Curry, M., Maloney, T., Woodroof, R., and Leonard, R. (2010) "Less Sand May Not Be Enough," paper SPE 131783). Also, reservoir simulations of hydraulically fractured unconventional and shale gas reservoirs show the importance of conductivity of primary fractures on well performance (Cipolla, C. L., Lolon, E. P., Mayerhofer, M. J., and Warpinski, N. R. (2009) "Fracture Design Considerations in Horizontal Wells Drilled in Unconventional Gas Reservoirs,: paper SPE 119366). Therefore, for optimal, sustained long term production, hydraulic fracture conductivity is desired, particularly in the area close to the wellbore, in shale gas formations.

SUMMARY

In a first aspect, a method of treating a subterranean formation of a well bore is disclosed. The method includes the steps of providing a first treatment fluid; subsequently, pumping the first treatment fluid to initiate a network of low conductivity fractures in the subterranean formation; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; and subsequently, pumping the second treatment fluid to initiate at least one high conductivity fracture in the subterranean formation, wherein the high conductivity fracture has a conductivity higher than the average of the conductivity of the low conductivity fractures and connects the network of low conductivity fractures created by the first treatment fluid.

In a second aspect, a method of treating a subterranean formation of a well bore is disclosed; the subterranean formation at least in part comprises shale. The method includes the steps of providing a first treatment fluid; subsequently, pumping the first treatment fluid to initiate a network of low conductivity fractures in the shale; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; and subsequently, pumping the second treatment fluid to initiate at least one high conductivity fracture in the shale, wherein the high conductivity fracture has a conductivity higher than the lowest of the conductivity of the low conductivity fractures and connects the network of low conductivity fractures initiated by the first treatment fluid.

In a last aspect, another method of treating a subterranean formation of a well bore is disclosed. The method includes the steps of providing a first treatment fluid without viscosifying agent; subsequently, pumping the first treatment fluid to initiate a network of low conductivity fractures in the shale; providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74; and subsequently, pumping the second treatment fluid to initiate at least one high conductivity fracture in the shale, wherein the high conductivity fracture has a conductivity higher than the lowest of the conductivity of the low conductivity fractures and connects the network of low conductivity fractures initated by the first treatment fluid.

DETAILED DESCRIPTION

At the outset, it should be noted that in the development of any actual embodiments, numerous implementation-specific decisions must be made to achieve the developer's specific goals, such as compliance with system and business related constraints, which can vary from one implementation to another. Moreover, it will be appreciated that such a development effort might be complex and time consuming but would nevertheless be a routine undertaking for those of ordinary skill in the art having the benefit of this disclosure.

The description and examples are presented solely for the purpose of illustrating embodiments of the invention and should not be construed as a limitation to the scope and applicability of the invention. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possession of the entire range and all points within the range disclosed and enabled the entire range and all points within the range.

The following definitions are provided in order to aid those skilled in the art in understanding the detailed description.

The term "treatment", or "treating", refers to any subterranean operation that uses a fluid in conjunction with a desired function and/or for a desired purpose. The term "treatment", or "treating", does not imply any particular action by the fluid.

The term "fracturing" refers to the process and methods of breaking down a geological formation and creating a fracture, i.e. the rock formation around a well bore, by pumping fluid at very high pressures, in order to increase production rates from a hydrocarbon reservoir. The fracturing methods otherwise use conventional techniques known in the art.

Figure 1:
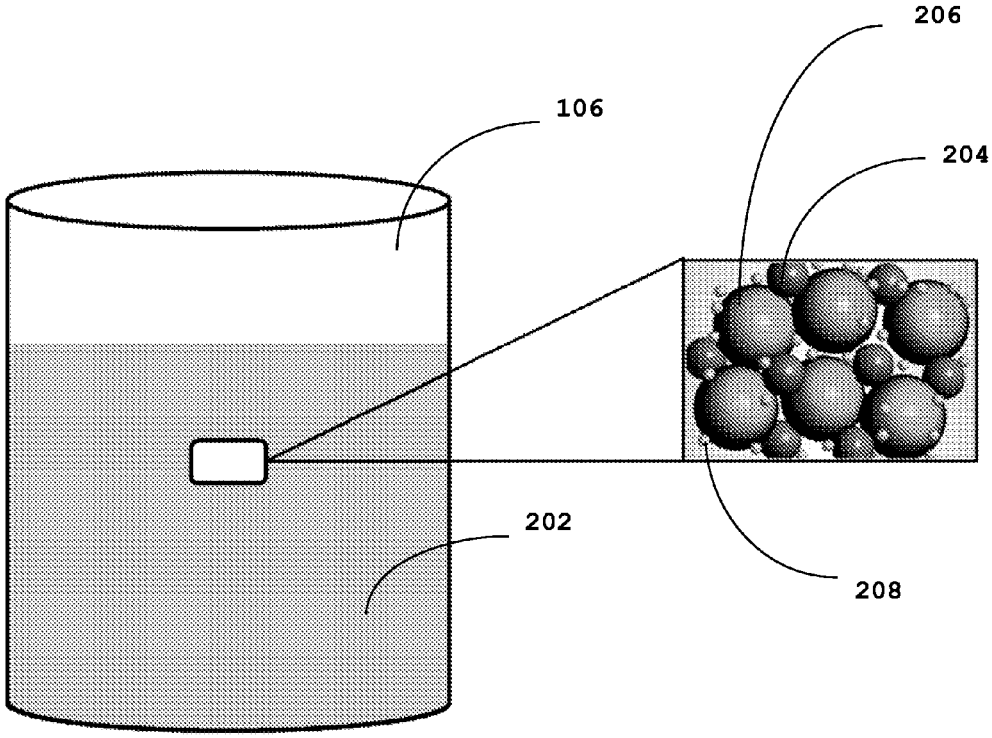
FIG. 1 shows an illustration of a composition used in the invention.
Figure 2:
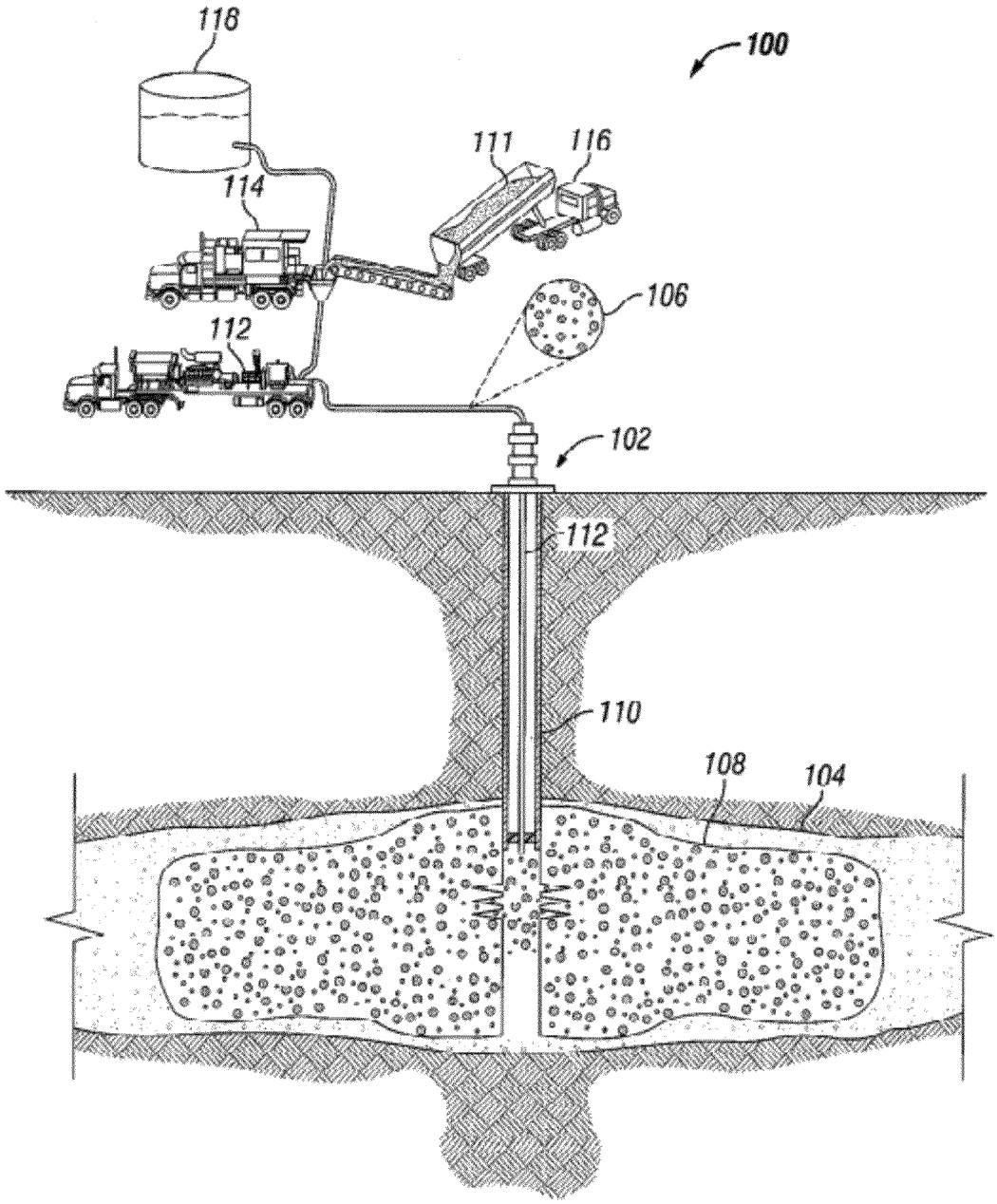
FIG. 2 shows an illustration of some embodiments.

FIG. 1 is a schematic diagram of a composition 106 made of high solids content fluid used in methods to create high conductivity hydraulic fractures in subterranean formations. The composition 106 includes a slurry of a carrier fluid 202 and a particulate blend made of proppant; the particulate blend comprising at least a first amount of particulates 204 having a first average particle size between about 100 and 5000 μm and at least a second amount of particulates 206 having a second average particle size between about three and twenty times smaller than the first average particle size. FIG. 2 is a schematic diagram of a well site to execute methods of the invention. The system 100 includes a wellbore 102 in fluid communication with a subterranean formation of interest 104. The formation of interest 104 may be any formation wherein fluid communication between a wellbore and the formation is desirable, including a hydrocarbon-bearing formation, a water-bearing formation, a formation that accepts injected fluid for disposal, pressurization, or other purposes, or any other formation understood in the art.

According to one embodiment, the method uses a first treatment fluid that includes a fluid having optionally a low amount of a viscosifier and a second treatment fluid made of composition 106 of high solids content fluid. The first treatment fluid can be embodied as a conventional fracturing slurry. The first treatment fluid is made of a first carrier fluid. The second treatment fluid is made of a second carrier fluid and a particulate blend made of proppant. The first or second carrier fluid includes any base fracturing fluid understood in the art. Some non-limiting examples of carrier fluids include hydratable gels (e.g. guars, poly-saccharides, xanthan, hydroxy-ethyl-cellulose, etc.), a cross-linked hydratable gel, a viscosified acid (e.g. gel-based), an emulsified acid (e.g. oil outer phase), an energized fluid (e.g. an $N_2$ or $CO_2$ based foam), and an oil-based fluid including a gelled, foamed, or otherwise viscosified oil. Additionally, the carrier fluid may be a brine, and/or may include a brine. Also the first or second carrier fluid may be a gas.

The viscosifying agent may be any crosslinked polymers. The polymer viscosifier can be a metal-crosslinked polymer. Suitable polymers for making the metal-crosslinked polymer viscosifiers include, for example, polysaccharides such as substituted galactomannans, such as guar gums, high-molecular weight polysaccharides composed of mannose and galactose sugars, or guar derivatives such as hydroxypropyl guar (HPG), carboxymethylhydroxypropyl guar (CMHPG) and carboxymethyl guar (CMG), hydrophobically modified guars, guar-containing compounds, and synthetic polymers. Crosslinking agents based on boron, titanium, zirconium or aluminum complexes are typically used to increase the effective molecular weight of the polymer and make them better suited for use in high-temperature wells.

Other suitable classes of polymers effective as viscosifying agent include polyvinyl polymers, polymethacrylamides, cellulose ethers, lignosulfonates, and ammonium, alkali metal, and alkaline earth salts thereof. More specific examples of other typical water soluble polymers are acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyalkyleneoxides, other galactomannans, heteropolysaccharides obtained by the fermentation of starch-derived sugar and ammonium and alkali metal salts thereof.

Cellulose derivatives are used to a smaller extent, such as hydroxyethylcellulose (HEC) or hydroxypropylcellulose (HPC), carboxymethylhydroxyethylcellulose (CMHEC) and carboxymethycellulose (CMC), with or without crosslinkers. Xanthan, diutan, and scleroglucan, three biopolymers, have been shown to have excellent particulate-suspension ability even though they are more expensive than guar derivatives and therefore have been used less frequently, unless they can be used at lower concentrations.

In other embodiments, the viscosifying agent is made from a crosslinkable, hydratable polymer and a delayed crosslinking agent, wherein the crosslinking agent comprises a complex comprising a metal and a first ligand selected from the group consisting of amino acids, phosphono acids, and salts or derivatives thereof. Also the crosslinked polymer can be made from a polymer comprising pendant ionic moieties, a surfactant comprising oppositely charged moieties, a clay stabilizer, a borate source, and a metal crosslinker. Said embodiments are described in U.S. Patent Publications US2008-0280790 and US2008-0280788 respectively, each of which are incorporated herein by reference.

The viscosifying agent may be a viscoelastic surfactant (VES). The VES may be selected from the group consisting of cationic, anionic, zwitterionic, amphoteric, nonionic and combinations thereof. Some non-limiting examples are those cited in U.S. Pat. No. 6,435,277 (Qu et al.) and U.S. Pat. No. 6,703,352 (Dahayanake et al.), each of which are incorporated herein by reference. The viscoelastic surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

In general, particularly suitable zwitterionic surfactants have the formula:

$$RCONH—(CH_2)_a(CH_2CH_2O)_m(CH_2)_b—N^+(CH_3)_2—(CH_2)_{a'}(CH_2CH_2O)_{m'}(CH_2)_{b'}COO^-$$

in which R is an alkyl group that contains from about 11 to about 23 carbon atoms which may be branched or straight chained and which may be saturated or unsaturated; a, b, a', and b' are each from 0 to 10 and m and m' are each from 0 to 13; a and b are each 1 or 2 if m is not 0 and (a+b) is from 2 to 10 if m is 0; a' and b' are each 1 or 2 when m' is not 0 and (a'+b') is from 1 to 5 if m is 0; (m+m') is from 0 to 14; and $CH_2CH_2O$ may also be $OCH_2CH_2$. In some embodiments, a zwitterionic surfactants of the family of betaine is used.

Exemplary cationic viscoelastic surfactants include the amine salts and quaternary amine salts disclosed in U.S. Pat. Nos. 5,979,557, and 6,435,277 which are hereby incorporated by reference. Examples of suitable cationic viscoelastic surfactants include cationic surfactants having the structure:

$$R_1N^+(R_2)(R_3)(R_4)X^-$$

in which $R_1$ has from about 14 to about 26 carbon atoms and may be branched or straight chained, aromatic, saturated or unsaturated, and may contain a carbonyl, an amide, a retroamide, an imide, a urea, or an amine; $R_2$, $R_3$, and $R_4$ are each independently hydrogen or a $C_1$ to about $C_6$ aliphatic group which may be the same or different, branched or straight chained, saturated or unsaturated and one or more than one of which may be substituted with a group that renders the $R_2$, $R_3$, and $R_4$ group more hydrophilic; the $R_2$, $R_3$ and $R_4$ groups may be incorporated into a heterocyclic 5- or 6-member ring structure which includes the nitrogen atom; the $R_2$, $R_3$ and $R_4$ groups may be the same or different; $R_1$, $R_2$, $R_3$ and/or $R_4$ may contain one or more ethylene oxide and/or propylene oxide units; and $X^-$ is an anion. Mixtures of such compounds are also suitable. As a further example, $R_1$ is from about 18 to about 22 carbon atoms and may contain a carbonyl, an amide, or an amine, and $R_2$, $R_3$, and $R_4$ are the same as one another and contain from 1 to about 3 carbon atoms.

Amphoteric viscoelastic surfactants are also suitable. Exemplary amphoteric viscoelastic surfactant systems include those described in U.S. Pat. No. 6,703,352, for example amine oxides. Other exemplary viscoelastic surfactant systems include those described in U.S. Pat. Nos. 6,239,183; 6,506,710; 7,060,661; 7,303,018; and 7,510,009 for example amidoamine oxides. These references are hereby incorporated in their entirety. Mixtures of zwitterionic surfactants and amphoteric surfactants are suitable. An example is a mixture of about 13% isopropanol, about 5% 1-butanol, about 15% ethylene glycol monobutyl ether, about 4% sodium chloride, about 30% water, about 30% cocoamidopropyl betaine, and about 2% cocoamidopropylamine oxide.

The viscoelastic surfactant system may also be based upon any suitable anionic surfactant. In some embodiments, the anionic surfactant is an alkyl sarcosinate. The alkyl sarcosinate can generally have any number of carbon atoms. Alkyl sarcosinates can have about 12 to about 24 carbon atoms. The alkyl sarcosinate can have about 14 to about 18 carbon atoms. Specific examples of the number of carbon atoms include 12, 14, 16, 18, 20, 22, and 24 carbon atoms. The anionic surfactant is represented by the chemical formula:

$$R_1CON(R_2)CH_2X$$

wherein $R_1$ is a hydrophobic chain having about 12 to about 24 carbon atoms, $R_2$ is hydrogen, methyl, ethyl, propyl, or butyl, and X is carboxyl or sulfonyl. The hydrophobic chain can be an alkyl group, an alkenyl group, an alkylarylalkyl group, or an alkoxyalkyl group. Specific examples of the hydrophobic chain include a tetradecyl group, a hexadecyl group, an octadecentyl group, an octadecyl group, and a docosenoic group.

The viscosifying agent may be present in lower amount than conventionally is included for a fracture treatment. The loading of a viscosifier, for example described in pounds of gel per 1,000 gallons of carrier fluid, is selected according to the particulate size (due to settling rate effects) and loading that the storable composition 106 must carry, according to the viscosity required to generate a desired fracture geometry, according to the pumping rate and casing or tubing configuration of the wellbore, according to the temperature of the formation of interest, and according to other factors understood in the art.

In certain embodiments, the low amount of a viscosifying agent includes a hydratable gelling agent in the carrier fluid at less than 20 pounds per 1,000 gallons of carrier fluid where the amount of particulates in the storable composition 106 are greater than 16 pounds per gallon of carrier fluid. In certain further embodiments, the low amount of a viscosifier includes a hydratable gelling agent in the carrier fluid at less than 20 pounds per 1,000 gallons of carrier fluid where the amount of particulates in the fracturing slurry 106 are greater than 23 pounds per gallon of carrier fluid. In certain embodiments, a low amount of a viscosifier includes a viscoelastic surfactant at a concentration below 1% by volume of carrier fluid. In certain embodiments, the low amount of a viscosifier includes the carrier fluid with no viscosifier included. In certain embodiments a low amount of a viscosifier includes values greater than the listed examples, because the circumstances of the storable composition conventionally utilize viscosifier amounts much greater than the examples. For example, in a high temperature application with a high proppant loading, the carrier fluid may conventionally indicate a viscosifier at 50 lbs. of gelling agent per 1,000 gallons of carrier fluid, wherein 40 lbs. of gelling agent, for example, may be a low amount of viscosifier. One of skill in the art can perform routine tests of storable composition based on certain particulate blends in light of the disclosures herein to determine acceptable viscosifier amounts for a particular embodiment.

In certain embodiments, the carrier fluid includes an acid. The fracture may be a traditional hydraulic bi-wing fracture, but in certain embodiments may be an etched fracture and/or wormholes such as developed by an acid treatment. The carrier fluid may include hydrochloric acid, hydrofluoric acid, ammonium bifluoride, formic acid, acetic acid, lactic acid, glycolic acid, maleic acid, tartaric acid, sulfamic acid, malic acid, citric acid, methyl-sulfamic acid, chloro-acetic acid, an amino-poly-carboxylic acid, 3-hydroxypropionic acid, a poly-amino-poly-carboxylic acid, and/or a salt of any acid. In certain embodiments, the carrier fluid includes a poly-amino-poly-carboxylic acid, and is a trisodium hydroxyl-ethyl-ethylene-diamine triacetate, mono-ammonium salts of hydroxyl-ethyl-ethylene-diamine triacetate, and/or mono-sodium salts of hydroxyl-ethyl-ethylene-diamine tetra-acetate. The selection of any acid as a carrier fluid depends upon the purpose of the acid—for example formation etching, damage cleanup, removal of acid-reactive particles, etc., and further upon compatibility with the formation, compatibility with fluids in the formation, and compatibility with other components of the fracturing slurry and with spacer fluids or other fluids that may be present in the wellbore. The selection of an acid for the carrier fluid is understood in the art based upon the characteristics of particular embodiments and the disclosures herein.

The first treatment fluid may be substantially free of macroscopic particulates i.e. without particulates or with alternate mixtures of particulates. For example, the first treatment fluid may be a pad fluid and/or a flush fluid in certain embodiments. In certain embodiments, the pad fluid is free of macroscopic particulates, but may also include microscopic particulates or other additives such as fluid loss additives, breakers, or other materials known in the art. The first treatment fluid may be a fracturing slurry made of the carrier fluid and proppant as described below, in this case the first treatment fluid comprises macroscopic particulates. In one embodiment, the fracturing slurry is a conventional fracturing slurry and is not high solid content fluid.

The particulate blend of the second treatment fluid includes particulate materials generally called proppant. Proppant involves many compromises imposed by economical and practical considerations. Criteria for selecting the proppant type, size, and concentration is based on the needed dimensionless conductivity, and can be selected by a skilled artisan. Such proppants can be natural or synthetic (including but not limited to glass beads, ceramic beads, sand, and bauxite), coated, or contain chemicals; more than one can be used sequentially or in mixtures of different sizes or different materials. The proppant may be resin coated, or pre-cured resin coated. Proppants and gravels in the same or different wells or treatments can be the same material and/or the same size as one another and the term proppant is intended to include gravel in this disclosure. In general the proppant used will have an average particle size of from about 0.15 mm to about 2.39 mm (about 8 to about 100 U.S. mesh), more particularly, but not limited to 0.25 to 0.43 mm (40/60 mesh), 0.43 to 0.84 mm (20/40 mesh), 0.84 to 1.19 mm (16/20), 0.84 to 1.68 mm (12/20 mesh) and 0.84 to 2.39 mm (8/20 mesh) sized materials. Normally the proppant will be present in the slurry in a concentration of from about 0.12 to about 0.96 kg/L, or from about 0.12 to about 0.72 kg/L, or from about 0.12 to about 0.54 kg/L.

In one embodiment, the second treatment fluid comprises particulate materials with defined particles size distribution. On example of realization is disclosed in U.S. Pat. No. 7,784,541, herewith incorporated by reference.

The second treatment fluid includes a first amount of particulates having a first average particle size between about 100 and 2000 μm. In certain embodiments, the first amount of particulates may be a proppant, for example sand, ceramic, or other particles understood in the art to hold a fracture 108 open after a treatment is completed. In certain embodiments, the first amount of particulates may be a fluid loss agent, for example calcium carbonate particles or other fluid loss agents known in the art. In certain embodiments, the first amount of particulates may be a degradable particulate, for example PLA particles or other degradable particulates known in the art. In certain embodiments, the first amount of particulates may be a chemical for example as viscosity breakers, corrosion inhibitors, inorganic scale inhibitors, organic scale inhibitors, gas hydrate control, wax, asphaltene control agents, catalysts, clay control agents, biocides, friction reducers and mixture thereof.

The second treatment fluid further includes a second amount of particulates having a second average particle size between about three times and about ten, fifteen or twenty times smaller than the first average particle size. For example, where the first average particle size is about 100 μm (an average particle diameter, for example), the second average particle size may be between about 5 μm and about 33 μm. In certain preferred embodiments, the second average particle size may be between about seven and ten times smaller than the first average particle size. In certain embodiments, the second amount of particulates may be a fluid loss agent, for example calcium carbonate particles or other fluid loss agents known in the art. In certain embodiments, the second amount of particulates may be a degradable particulate, for example PLA particles or other degradable particulates known in the art. In certain embodiments, the second amount of particulates may be a chemical for example as viscosity breakers, corrosion inhibitors, inorganic scale inhibitors, organic scale inhibitors, gas hydrate control, wax, asphaltene control agents, catalysts, clay control agents, biocides, friction reducers and mixture thereof.

In certain embodiments, the selection of the size for the first amount of particulates is dependent upon the characteristics of the propped fracture 108, for example the closure stress of the fracture, the desired conductivity, the size of fines or sand that may migrate from the formation, and other considerations understood in the art. In certain further embodiments, the selection of the size for the first amount of particulates is dependent upon the desired fluid loss characteristics of the first amount of particulates as a fluid loss agent, the size of pores in the formation, and/or the commercially available sizes of particulates of the type comprising the first amount of particulates.

In certain embodiments, the selection of the size of the second amount of particulates is dependent upon maximizing a packed volume fraction (PVF) of the mixture of the first amount of particulates and the second amount of particulates. The packed volume fraction or packing volume fraction (PVF) is the fraction of solid content volume to the total volume content. A second average particle size of between about seven to ten times smaller than the first amount of particulates contributes to maximizing the PVF of the mixture, but a size between about three to twenty times smaller, and in certain embodiments between about three to fifteen times smaller, and in certain embodiments between about three to ten times smaller will provide a sufficient PVF for most systems 100. Further, the selection of the size of the second amount of particulates is dependent upon the composition and commercial availability of particulates of the type comprising the second amount of particulates. For example, where the second amount of particulates comprise wax beads, a second average particle size of four times (4×) smaller than the first average particle size rather than seven times (7×) smaller than the first average particle size may be used if the 4× embodiment is cheaper or more readily available and the PVF of the mixture is still sufficient to acceptably suspend the particulates in the carrier fluid. In certain embodiments, the particulates combine to have a PVF above 0.74 or 0.75 or above 0.80. In certain further embodiments the particulates may have a much higher PVF approaching 0.95.

In certain embodiments, the second treatment fluid further includes a third amount of particulates having a third average particle size that is smaller than the second average particle size. In certain further embodiments, the second treatment fluid may have a fourth amount of particulates having a fourth average particle size that is smaller than the third average particle size. In certain further embodiments, the second treatment fluid may have a fifth amount of particulates having a fifth average particle size that is smaller than the fourth average particle size. In certain further embodiments, the second treatment fluid may have a sixth amount of particulates having a sixth average particle size that is smaller than the fifth average particle size. In certain further embodiments, the second treatment fluid may have a seventh amount of particulates having a seventh average particle size that is smaller than the sixth average particle size. In certain further embodiments, the particulate blend is a combination of various different particles within one defined first, second, third, fourth, sixth, or seventh average particle size. For example, the second treatment fluid may be made of a first amount of particulates having a first average particle size with proppant and degradable particles, a second amount of particulates having a second average particle size smaller than the first average particle size with proppant and fluid loss agent, and a third amount of particulates having a third average particle size smaller than the second average particle size with corrosion inhibitors and inorganic scale inhibitors. For the purposes of enhancing the PVF of the second treatment fluid, more than three or four particles sizes will not typically be required. For example, a four-particle blend including 217 g of 20/40 mesh sand, 16 g or poly-lactic acid particles with an average size of 150 microns, 24 g of poly-lactic acid particles with an average size of 8 microns, and 53 g of $CaCO_3$ particles with an average size of 5 microns creates a particulate blend 111 having a PVF of about 0.863. In a second example, a three-particle blend wherein each particle size is 7× to 10× smaller than the next larger particle size creates a particulate blend 111 having a PVF of about 0.95. However, additional particles may be added for other reasons, such as the chemical composition of the additional particles, the ease of manufacturing certain materials into the same particles versus into separate particles, the commercial availability of particles having certain properties, and other reasons understood in the art.

In certain embodiments, the system 100 includes a pumping device 112 structured to create a fracture 108 in the formation of interest 104 with the first treatment fluid. The system 100 in certain embodiments further includes peripheral devices such as a blender 114, a particulates hauler 116, fluid storage tank(s) 118, and other devices understood in the art. In certain embodiments, the carrier fluid may be stored in the fluid storage tank 118, or may be a fluid created by mixing additives with a base fluid in the fluid storage tank 118 to create the carrier fluid. The particulates may be added from a conveyor 120 at the blender 114, may be added by the blender 114, and/or may be added by other devices (not shown). In certain embodiments, one or more sizes of particulates may be pre-mixed into the particulate blend 111. For example, if the second treatment fluid includes a first amount, second amount, and third amount of particulates, a particulate blend 111 may be premixed and include the first amount, second amount, and third amount of particulates. In certain embodiments, one or more particulate sizes may be added at the blender 114 or other device. For example, if the second treatment fluid includes a first amount, second amount, and third amount of particulates, a particulate blend 111 may be premixed and include the first amount and second amount of particulates, with the third amount of particulates added at the blender 114.

In certain embodiments, the first or second treatment fluid includes a degradable material. In certain embodiments for the second treatment fluid, the degradable material is making up at least part of the second amount of particulates. For example, the second amount of particulates may be completely made from degradable material, and after the fracture treatment the second amount of particulates degrades and flows from the fracture 108 in a fluid phase. In another example, the second amount of particulates includes a portion that is degradable material, and after the fracture treatment the degradable material degrades and the particles break up into particles small enough to flow from the fracture 108. In certain embodiments, the second amount of particulates exits the fracture by dissolution into a fluid phase or by dissolution into small particles and flowing out of the fracture.

In certain embodiments, the degradable material includes at least one of a lactide, a glycolide, an aliphatic polyester, a poly (lactide), a poly (glycolide), a poly (ϵ-caprolactone), a poly (orthoester), a poly (hydroxybutyrate), an aliphatic polycarbonate, a poly (phosphazene), and a poly (anhydride). In certain embodiments, the degradable material includes at least one of a poly (saccharide), dextran, cellulose, chitin, chitosan, a protein, a poly (amino acid), a poly (ethylene oxide), and a copolymer including poly (lactic acid) and poly (glycolic acid). In certain embodiments, the degradable material includes a copolymer including a first moiety which includes at least one functional group from a hydroxyl group, a carboxylic acid group, and a hydrocarboxylic acid group, the copolymer further including a second moiety comprising at least one of glycolic acid and lactic acid.

In some embodiments, the first or second treatment fluid may optionally further comprise additional additives, including, but not limited to, acids, fluid loss control additives, gas, corrosion inhibitors, scale inhibitors, catalysts, clay control agents, biocides, friction reducers, combinations thereof and the like. For example, in some embodiments, it may be desired to foam the first or second treatment fluid using a gas, such as air, nitrogen, or carbon dioxide. In one certain embodiment, the second treatment fluid may contain a particulate additive, such as a particulate scale inhibitor.

Figure 3:
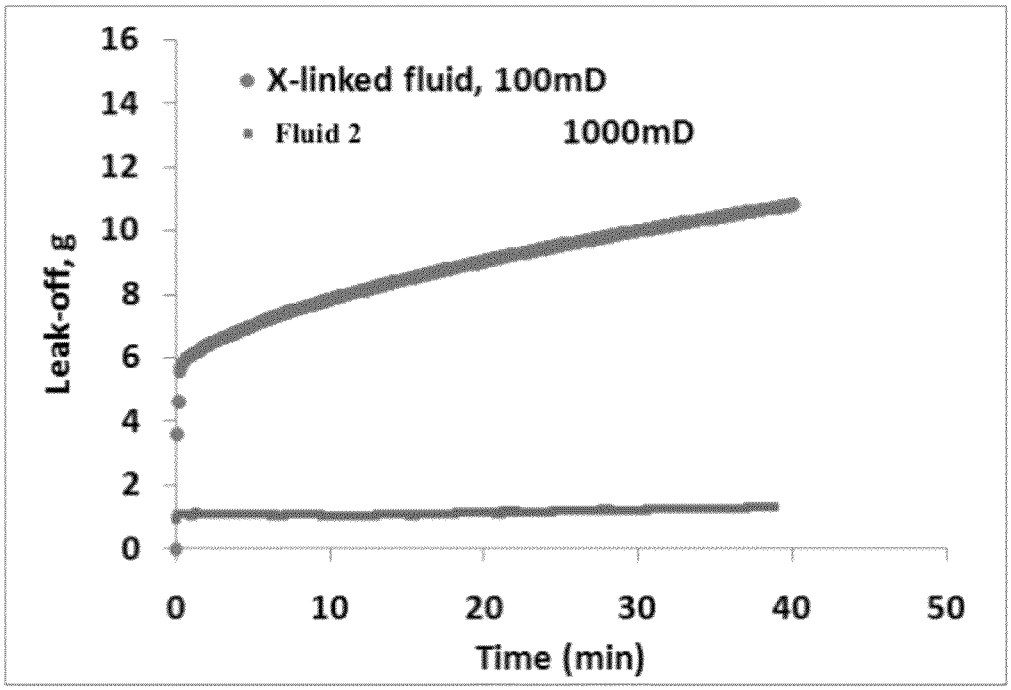
FIG. 3 shows leakoff property of fluid according to the invention compared to conventional crosslinked fluid.

FIG. 3 shows a comparison of the fluid leakoff properties of a conventional crosslinked fluid and of the second treatment fluid. Note that the two experiments were done on two different permeability cores. If test for crosslinked fluid were also performed on 1000 mD core, leakoff control will never be built, i.e. the fluid (1000 mL) in the fluid loss cell will be lost within minutes. This leakoff control enables the second treatment fluid (noted fluid 2) to be used in formation with high permeability, with natural fracture or with pre-exist fracture.

Figure 4:
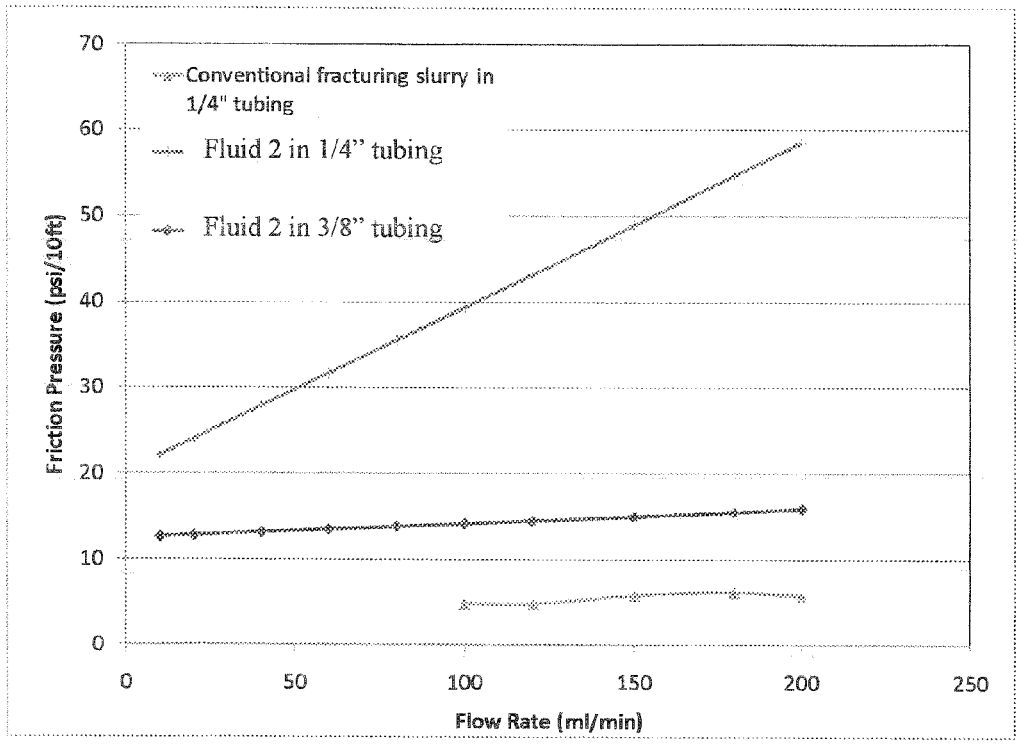
FIG. 4 shows comparison of friction pressure of fluid according to the invention and conventional slurry.

When the second treatment fluid is used without any added viscosifying agent, the apparent viscosities are not very high, usually in a few hundreds cPs, but the second treatment fluid has a unique friction pressure behavior (due to the fluid formulation) when flowing in narrow gap/tubing. Shown in FIG. 4 is a comparison of friction pressures of the second treatment fluid (noted fluid 2) with conventional fracturing slurry. When flowing in a ¼ inch tubing, the friction pressure of the second treatment fluid is much higher than that of the conventional frac slurry. When flowing the second treatment fluid in a wider tubing, ⅜ inch, the friction pressure drops dramatically. This indicates that the high friction behavior of the second treatment fluid is mainly in the narrow gap, such as in a hydraulic fracture. Therefore it is advantageous to use the second treatment fluid to frac, the high friction pressure in narrow gap will create large net pressure for the fluid to create fracture width, but not so high friction pressure in tubing will allow less impact when pumped through tubing/casing. However, it also needs to be noted that the fracture created with the second treatment fluid will tend to be shorter though wider.

In an exemplary embodiment, a method is disclosed to use the second treatment fluid in hydraulic fracturing treatments to create high conductivity flow channels after a fracture network of large surface area is created by hydraulic fracturing treatments using low viscosity fluid. The conductivity of a fracture is defined as a dimensionless value, the fracture conductivity, noted $C_{fD}$, and defined as $C_{fD}=k_f b/k_F L_f$ with $k_f$ fracture permeability, $L^2$, md; b fracture width, L, ft; $k_F$=formation permeability, $L^2$, md; and $L_f$ fracture half-length (wellbore to tip), L, ft.

Figure 5:
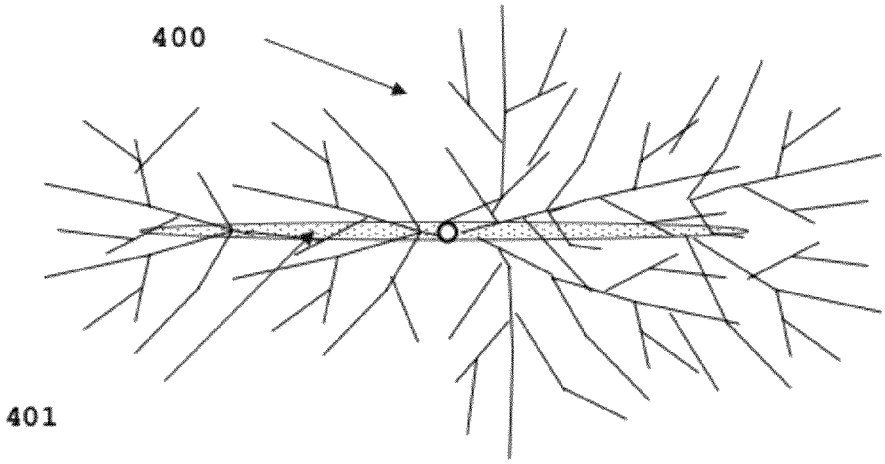
FIG. 5 shows schematic map view of a high conductivity hydraulic fracture connecting hydraulic fracture network created in a subterranean formation according to the invention.

According to one embodiment, the method is used in a subterranean formation made of rocks wherein at least part of the rock is shale. FIG. 5 shows a schematic diagram of this embodiment. In the extreme low permeability shale formations, the first treatment fluid made of low viscosity fluid is first used in a hydraulic fracturing treatment (water frac) to create a complex fracture network 400 with large surface area and large total fracture length made of low conductivity fractures. After the network is created, the second treatment fluid is used in a secondary fracturing treatment (follow-up fracturing treatment or re-fracturing treatment) to create a high conductivity fracture 401 that connects the many branches of the complex fracture network 400. The high conductivity fracture is likely to be planar as shown in FIG. 5, because of its high viscosity and good leakoff control to existing fracture network. Leakoff control is very important in fracturing treatment of formation with existing fractures (natural fractures, and in this application, previously created hydraulic fracture network). It is conceivable that a secondary fracturing treatment using conventional fluids may follow the previous fracture path and may not create a new planar fracture to intercept many branches of previously created network. The conductivity of the flow channel created by the high conductivity fracture is particularly important. This channel connects the hydraulic fracture network and collects the flow from the many branches of the network and its conductivity will greatly affect the pressure drop of the increased flow rate of the converging flow from the branches during hydrocarbon production.

According to another embodiment, the method is used in horizontal wells. In deep formations, hydraulic fractures are usually vertical. When the well is horizontal, the connection between the fracture and the wellbore is very limited. If the proppant settles below the depth of the wellbore, the connection between the fracture and the wellbore will be poor or lost. This situation exists in both planar fractures and complex fracture networks, when the fracture grows much below the wellbore and when fracture closure time is long. In this case, the second treatment fluid is used to create a near wellbore fracture that vertically connects the wellbore and the previously created planar fracture or complex fracture network. The key here is the high vertical conductivity flow channel provided by a high conductivity fracture due to its no-settling property. The second treatment fluid is carried out in a secondary fracturing treatment (follow-up fracturing treatment or re-fracturing treatment).

According to another embodiment, the method is used for low permeability formation. For low permeability formations, the length and surface area of a hydraulic fracture is considered more important than its conductivity. However, numerous post-fracturing production analyses show less than expected production increase, and often, the reason is attributed to lost or damaged fracture conductivity. The fracture conductivity is particularly important in the part of the fracture close to the wellbore where the flow rate is high during production. In such cases, the second treatment fluid can be used in a secondary fracturing treatment to create a high conductivity flow channels that connect the wellbore and the large surface area of a low conductivity fracture to achieve both large surface area and high conductivity in the critical near wellbore area.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

What is claimed is:

1. A method of treating a subterranean formation of a well bore, comprising:

a. providing a first treatment fluid comprising a fracturing slurry comprising a first carrier fluid and proppant;

b. subsequently, pumping the first treatment fluid to initiate and create a complex network of low conductivity fractures in the subterranean formation;

c. providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74, wherein the second treatment fluid has a higher viscosity relative to the first treatment fluid; and d. subsequently to creation of the complex network, pumping the second treatment fluid in a secondary fracturing treatment operation to initiate at least one high conductivity fracture in the subterranean formation intercepting a plurality of branches of the complex network created by pumping the first treatment fluid, wherein the high conductivity fracture has a conductivity higher than an average conductivity of the low conductivity fractures and connects the network of the low conductivity fractures to the well bore.

2. The method of claim 1, wherein the first treatment fluid comprises a slick water fluid.

3. The method of claim 1, wherein the first treatment fluid comprises a first viscosifying agent, wherein the first viscosifying agent includes a member selected from a hydratable gelling agent at less than 20 lbs per 1,000 gallons of first carrier fluid, and a viscoelastic surfactant at a concentration less than 1% by volume of first carrier fluid.

4. The method of claim 1, wherein the first treatment fluid comprises a first friction reducer agent.

5. The method of claim 1, wherein the second carrier fluid further includes a second viscosifying agent or a second friction reducer agent.

6. The method of claim 5, wherein the second viscosifying agent includes a member selected from a hydratable gelling agent at less than 20 lbs per 1,000 gallons of second carrier fluid, and a viscoelastic surfactant at a concentration less than 1% by volume of second carrier fluid.

7. The method of claim 1, wherein the second amount of particulates comprises one of a proppant, a fluid loss additive and a degradable material.

8. The method of claim 1, wherein the second treatment fluid further comprises a degradable particulate material.

9. The method of claim 1, wherein the first amount of particulates comprise one of a proppant, a fluid loss additive and a degradable material.

10. The method of claim 1, wherein the packed volume fraction of the particulate blend exceeds 0.8.

11. The method of claim 1, wherein the first amount of particulates is a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

12. The method of claim 1, wherein the second amount of particulates is a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

13. The method of claim 1, wherein the first treatment fluid further comprises a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

14. The method of claim 1, wherein the second treatment fluid further comprises a chemical selected from the list consisting of: viscosity breaker, corrosion inhibitors, inorganic scale inhibitors, organic scale inhibitors, gas hydrate control, wax, asphaltene control agents, catalysts, clay control agents, biocides, friction reducers and mixture thereof.

15. The method of claim 1, wherein the particulate blend further includes a third amount of particulates having a third average particulate size that is smaller than the second average particulate size.

16. The method of claim 15, wherein the particulate blend further includes a fourth amount of particulates having a fourth average particulate size that is smaller than the third average particulate size.

17. The method of claim 16, wherein the particulate blend further includes a fifth amount of particulates having a fifth average particulate size that is smaller than the fourth average particulate size.

18. The method of claim 1, wherein at least a part of the well is horizontal.

19. The method of claim 1, wherein the subterranean formation comprises at least in part shale rock.

20. The method of claim 1, wherein the first treatment fluid comprises 0.25 to 3 ppa proppant of 40/70 to 100 mesh size and has a viscosity of 1 to 10 cp, and wherein the second treatment fluid comprises greater than 16 ppa proppant and a relatively higher viscosity than the first treatment fluid.

21. The method of claim 20, wherein the at least one high conductivity fracture is planar.

22. A method of treating a subterranean formation of a well bore, wherein the subterranean formation at least in part comprises shale, comprising:

a. providing a first treatment fluid comprising a fracturing slurry comprising a first carrier fluid and proppant;

b. subsequently, pumping the first treatment fluid to initiate and create a complex network of low conductivity fractures in the shale;

c. providing a second treatment fluid comprising a second carrier fluid, a particulate blend including a first amount of particulates having a first average particle size between about 100 and 2000 μm and a second amount of particulates having a second average particle size between about three and twenty times smaller than the first average particle size, such that a packed volume fraction of the particulate blend exceeds 0.74, wherein the second treatment fluid has a higher viscosity relative to the first treatment fluid; and d. subsequently to creation of the complex network, pumping the second treatment fluid in a secondary fracturing treatment operation to initiate at least one high conductivity fracture in the shale intercepting a plurality of branches of the complex network created by pumping the first treatment fluid, wherein the high conductivity fracture has a conductivity higher than a lowest conductivity of the low conductivity fractures and connects the network of the low conductivity fractures to the well bore.

23. The method of claim 22, wherein the high conductivity fracture has a conductivity higher than an average of the conductivity of the low conductivity fractures.

24. The method of claim 22, wherein the packed volume fraction of the particulate blend exceeds 0.8.

25. The method of claim 22, wherein at least a part of the well is horizontal.

26. A method of treating a subterranean shale formation of a well bore, comprising:

a. providing a first treatment fluid without viscosifying agent, wherein the first treatment fluid comprises 0.25 to 3 ppa proppant;

b. subsequently, pumping the first treatment fluid to initiate and create a complex network of low conductivity fractures in the shale formation;

c. providing a second treatment fluid comprising a second carrier fluid, a particulate blend including a first amount of particulates having a first average particle size between about 100 and 2000 μm at a loading of greater than 16 ppa, and a second amount of particulates having a second average particle size between about three and twenty times smaller than the first average particle size, such that a packed volume fraction of the particulate blend exceeds 0.74, wherein the second treatment fluid comprises a viscosifying agent including a member selected from a hydratable gelling agent at less than 20 lbs per 1,000 gallons of second carrier fluid, and a viscoelastic surfactant at a concentration less than 1% by volume of second carrier fluid; and d. subsequently to creation of the complex network, pumping the second treatment fluid in a secondary fracturing treatment operation to initiate at least one high conductivity fracture in the shale intercepting a plurality of branches of the complex network created by pumping the first treatment fluid, wherein the high conductivity fracture has a conductivity higher than the lowest of the conductivity of the low conductivity fractures and connects the network of the low conductivity fracture.

27. The method of claim 26, wherein the high conductivity fracture has a conductivity higher than an average of the conductivity of the low conductivity fractures.

28. The method of claim 26, wherein the first treatment fluid comprises a first carrier fluid, and a first friction reducer agent.

29. The method of claim 26, wherein at least a part of the well is horizontal.

* * * * *